US009226600B2

(12) United States Patent
Carter et al.

(10) Patent No.: US 9,226,600 B2
(45) Date of Patent: Jan. 5, 2016

(54) CONVERTIBLE TEMPERATURE-CONTROLLED DISPLAY CASE

(71) Applicant: Hill Phoenix, Inc., Conyers, GA (US)

(72) Inventors: William J. Carter, Keosauqua, IA (US); David W. Hoaglin, Hillsboro, IA (US)

(73) Assignee: Hill Phoenix, Inc., Conyers, GA (US)

( * ) Notice: Subject to any disclaimer, the term of this patent is extended or adjusted under 35 U.S.C. 154(b) by 341 days.

(21) Appl. No.: 13/854,568

(22) Filed: Apr. 1, 2013

(65) Prior Publication Data

US 2013/0269382 A1 Oct. 17, 2013

Related U.S. Application Data

(60) Provisional application No. 61/623,449, filed on Apr. 12, 2012.

(51) Int. Cl.
*A47F 3/04* (2006.01)
*A47F 3/00* (2006.01)

(52) U.S. Cl.
CPC ..... *A47F 3/0486* (2013.01); *A47F 3/007* (2013.01); *A47F 3/043* (2013.01); *A47F 3/0408* (2013.01); *A47F 3/0469* (2013.01); *A47F 2003/008* (2013.01)

(58) Field of Classification Search
CPC ..... A47F 3/0443; F25D 17/065
USPC ..... 62/246, 255, 258, 407, 440; 312/138.1, 312/236
See application file for complete search history.

(56) References Cited

U.S. PATENT DOCUMENTS

| | | | | |
|---|---|---|---|---|
| 2,479,135 | A * | 8/1949 | Rutishauser | 62/249 |
| 5,168,719 | A * | 12/1992 | Branz et al. | 62/258 |
| 6,467,294 | B1 * | 10/2002 | Walker et al. | 62/255 |
| 6,547,346 | B2 * | 4/2003 | Topper et al. | 312/116 |

* cited by examiner

*Primary Examiner* — Melvin Jones
(74) *Attorney, Agent, or Firm* — Foley & Lardner LLP

(57) ABSTRACT

A temperature-controlled display case is convertible between a full-service mode and a self-service mode and defines a temperature-controlled space therein. A base has a back side and a front side, and supports temperature-controlled food products within the temperature-controlled space. A pedestal is disposed beneath the base and includes a pocket. A back frame is coupled adjacent to the back side of the base and has openings to provide back side access to the food products during the full-service mode. A top frame is supported by the back frame. A front panel has an upper portion and a lower portion, and is movable between a deployed position for the full-service mode with the upper portion of the front panel adjacent to the top frame, and a stowed position for the self-service mode with the front panel disposed within the pocket to provide front side access to the food products.

17 Claims, 6 Drawing Sheets

CONVERTIBLE TEMPERATURE-CONTROLLED DISPLAY CASE

CROSS-REFERENCE TO RELATED APPLICATION

This application claims the benefit of priority to U.S. Provisional Patent Application No. 61/623,449, which was filed on Apr. 12, 2012, the complete disclosure of which is incorporated by reference herein.

FIELD

The present disclosure relates generally to the field of temperature-controlled display devices (e.g. refrigerated food service cases, heated food service cases, etc.). More specifically, the present disclosure relates to a temperature-controlled case that is convertible between a full-service mode/configuration and a self-service mode/configuration. Still more specifically, the present disclosure relates to a convertible temperature-controlled case where a front panel is movable between a deployed position in front of the case during the full-service mode and a refracted (or stowed) position within the case during the self-service mode.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It is well known to provide a temperature controlled display device such as a refrigerator, freezer, refrigerated merchandiser, refrigerated display case, etc., that may be used in commercial, institutional, and residential applications for storing or displaying refrigerated or frozen objects. For example, it is known to provide full-service type refrigerated display cases for displaying fresh food products such as beef, pork, poultry, fish, etc. Such display cases typically have a closed front (e.g. with rear doors or openings for back-side access to the food products within the temperature controlled space by service personnel at a customer's request). It is also known to provide self-service type refrigerated cases that typically have an open-front to permit convenient front-side access directly by customers and that uses a flow of chilled air that is discharged across the open front of the case to help maintain a desired temperature within the temperature-controlled space. However, such full-service and self-service type cases do not generally provide a merchant (e.g. supermarket, food-retailer, etc.) with the desired flexibility or versatility of converting a case between a full-service mode and a self-service mode of operation.

SUMMARY

One embodiment of the disclosure relates to a temperature-controlled display case that is convertible for operation in both a full-service mode and a self-service mode and defines a temperature-controlled space therein. The case includes a base having a back side and a front side, and is configured to support temperature-controlled food products within the temperature-controlled space. A pedestal is disposed beneath the base and has a pocket defined therein. A back frame is coupled adjacent to the back side of the base and provides one or more openings configured to provide back side access to the food products during the full-service mode. A top frame is supported by the back frame. A front panel has an upper portion and a lower portion, and is movable between a deployed position for the full-service mode with the upper portion of the front panel adjacent to the top frame, and a stowed position for the self-service mode with the front panel disposed within the pocket to provide front side access to the food products.

BRIEF DESCRIPTION OF THE DRAWINGS

Exemplary embodiments will hereafter be described with reference to the accompanying drawings, wherein like numerals denote like elements.

DETAILED DESCRIPTION

Figure 1:
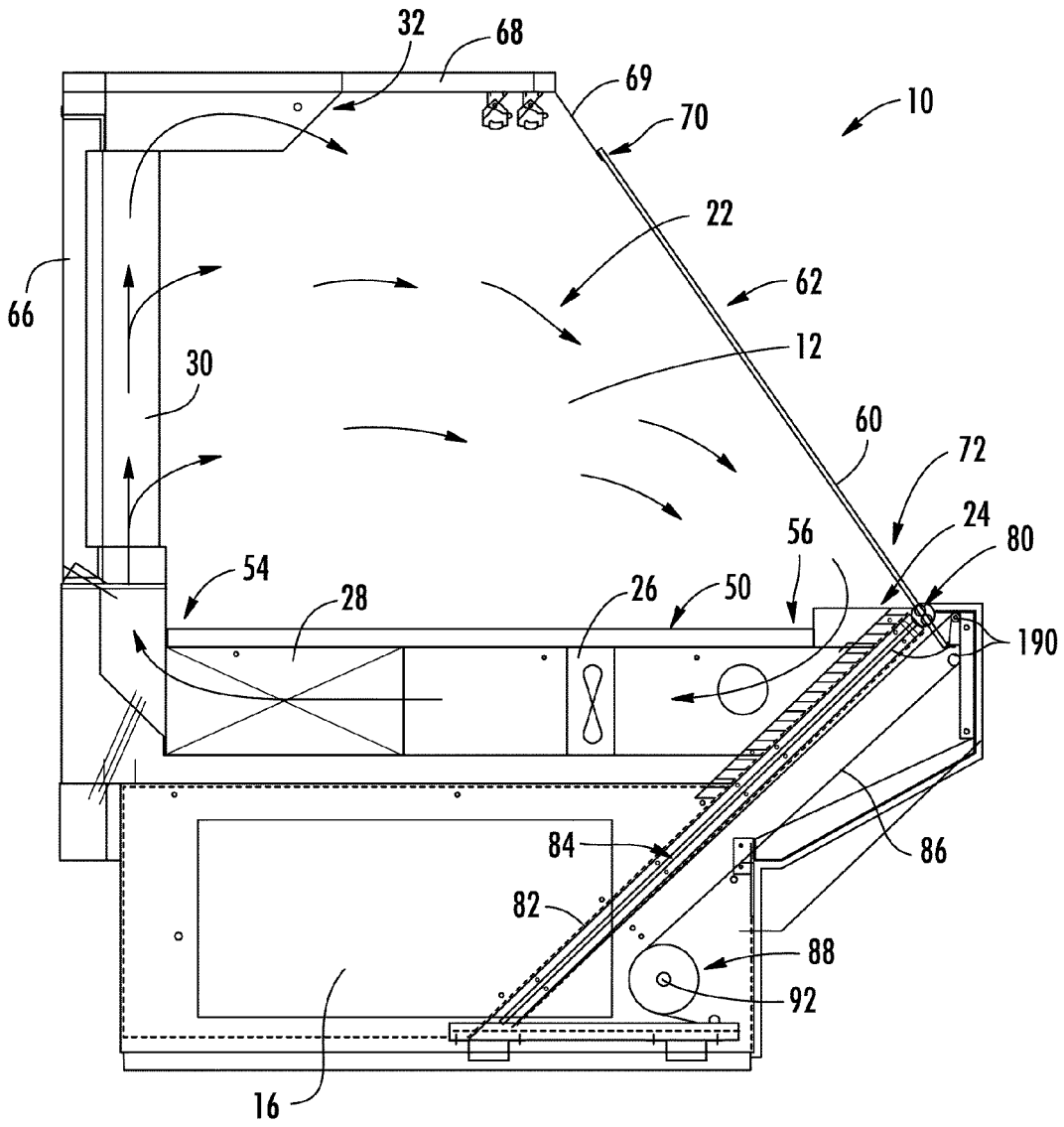
FIG. 1 is a schematic image of a side elevation view of a convertible temperature-controlled display device for refrigerated food products having a front panel disposed in a fully-deployed position corresponding to use in a full-service mode of operation, according to an exemplary embodiment.
Figure 2:
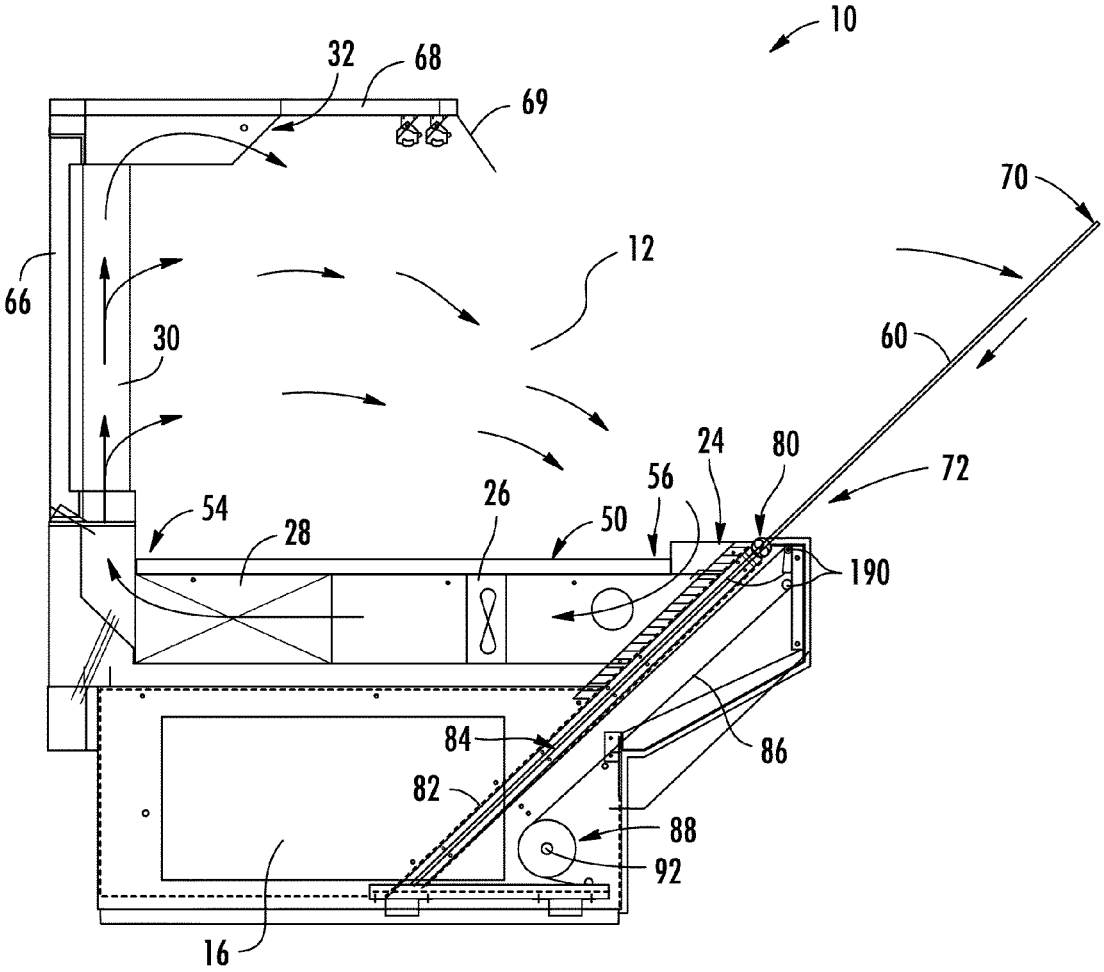
FIG. 2 is a schematic image of a side elevation view of the convertible temperature-controlled display device of FIG. 1 having the front panel disposed in an intermediate position transitioning from a full-service mode to a self-service mode of operation.
Figure 3:
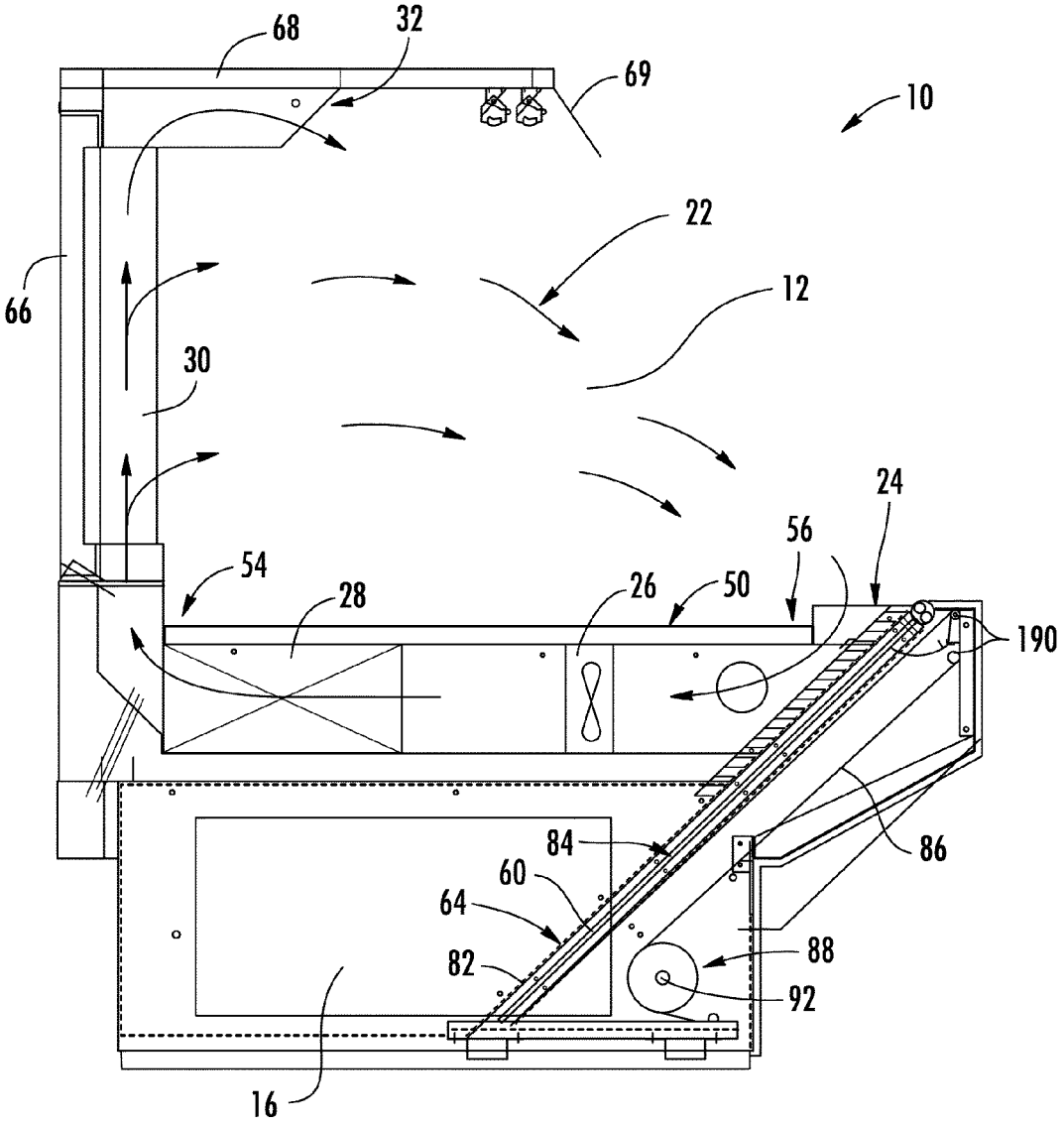
FIG. 3 is a schematic image of a side elevation view of the convertible temperature-controlled display device of FIG. 1 having the front panel disposed in a retracted (e.g. stowed) position corresponding to use in a self-service mode of operation.

Referring to FIGS. 1-3, a convertible temperature-controlled display device or case 10 is shown according to an exemplary embodiment for use with refrigerated food products. As shown by way of example in the illustrated embodiment, the case 10 includes refrigeration system components providing an air-flow pattern 22 for the flow of refrigerated air that is drawn in through a return opening 24 by a fan 26 and discharged through a cooling coil 28 (e.g. evaporator, etc.) into a duct or plenum 30 and distributed through a plurality of openings into a temperature controlled space 12 and through an upper duct opening 32 to form a circulating flow path of chilled air flowing downwardly across the front and into the return opening 24 to continue the airflow pattern. As further shown by way of example in the illustrated embodiment of FIGS. 1-3, the case 10 is convertible between a full-service mode with a front panel 60 in a deployed position 62 (see FIG. 1) and a self-service mode with the front panel 60 in a stowed position 64 within a pedestal or stand 16, beneath a display base 50 (or platform) of the case 10 (see FIG. 3). According to another embodiment, other refrigeration system components, such as cooling coils or plates may be provided, through which a coolant flows to provide direct contact cooling to products stored and displayed on the base or platform. All such embodiments are intended to be within the scope of this disclosure. Although case 10 is shown by way of example as including an evaporator coil and a fan, other types of cooling devices and technologies may be used to provide cooling to the food products in the temperature space, such as (for example) product support pans having a chilled coolant circulated therethrough and/or gravity coils or serpentine coils disposed within an upper portion of the temperature controlled space, such as those described more particularly in U.S. Pat. Nos. 6,981,385 and 6,915,652, the complete disclosures of which are hereby incorporated by reference in their entirety. All such variations are intended to be within the scope of this disclosure.

Figure 4:
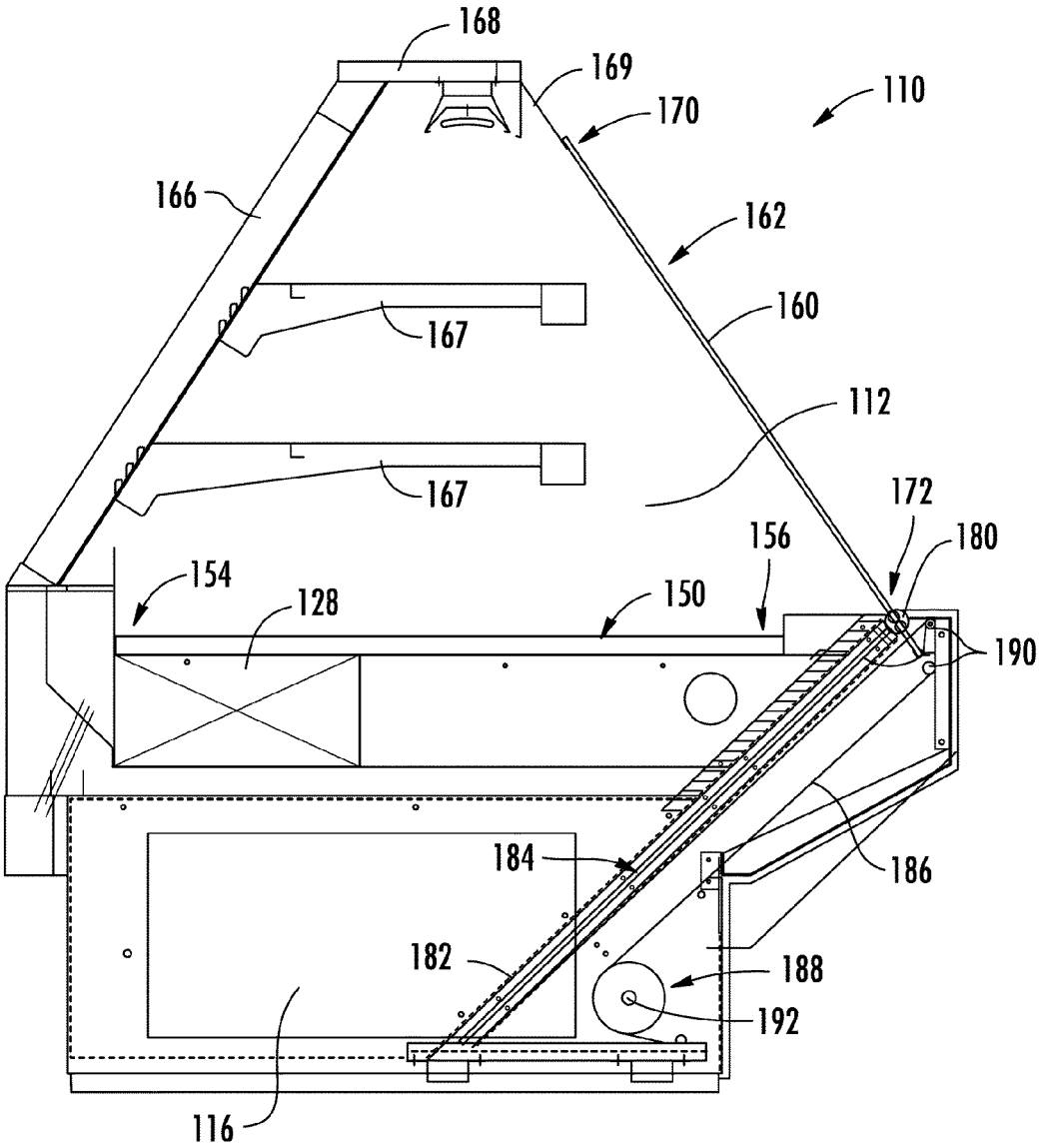
FIG. 4 is a schematic image of a side elevation view of a convertible temperature-controlled display device for heated food products having a front panel disposed in a fully-deployed position corresponding to use in a full-service mode of operation, according to an exemplary embodiment.
Figure 5:
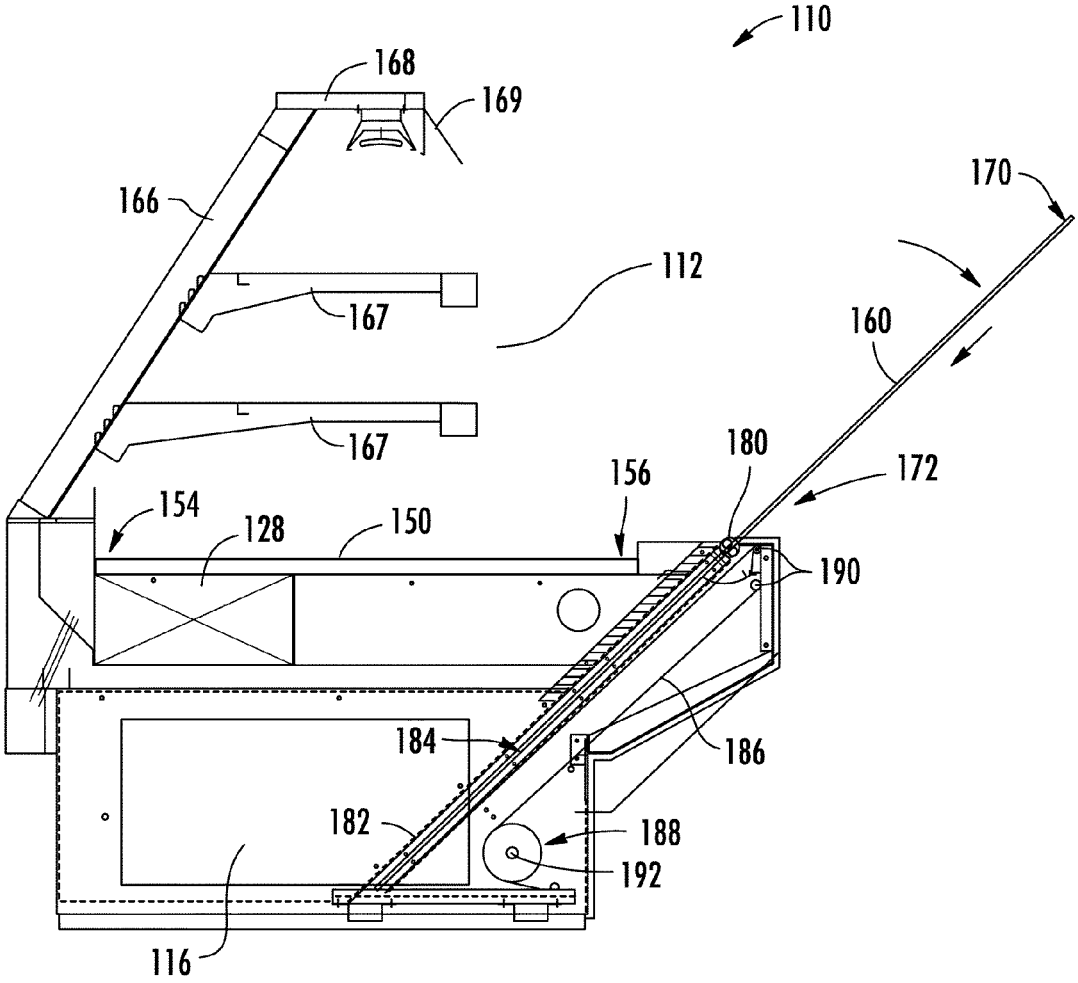
FIG. 5 is a schematic image of a side elevation view of the convertible temperature-controlled display device of FIG. 1 having the front panel disposed in an intermediate position transitioning from a full-service mode to a self-service mode of operation.
Figure 6:
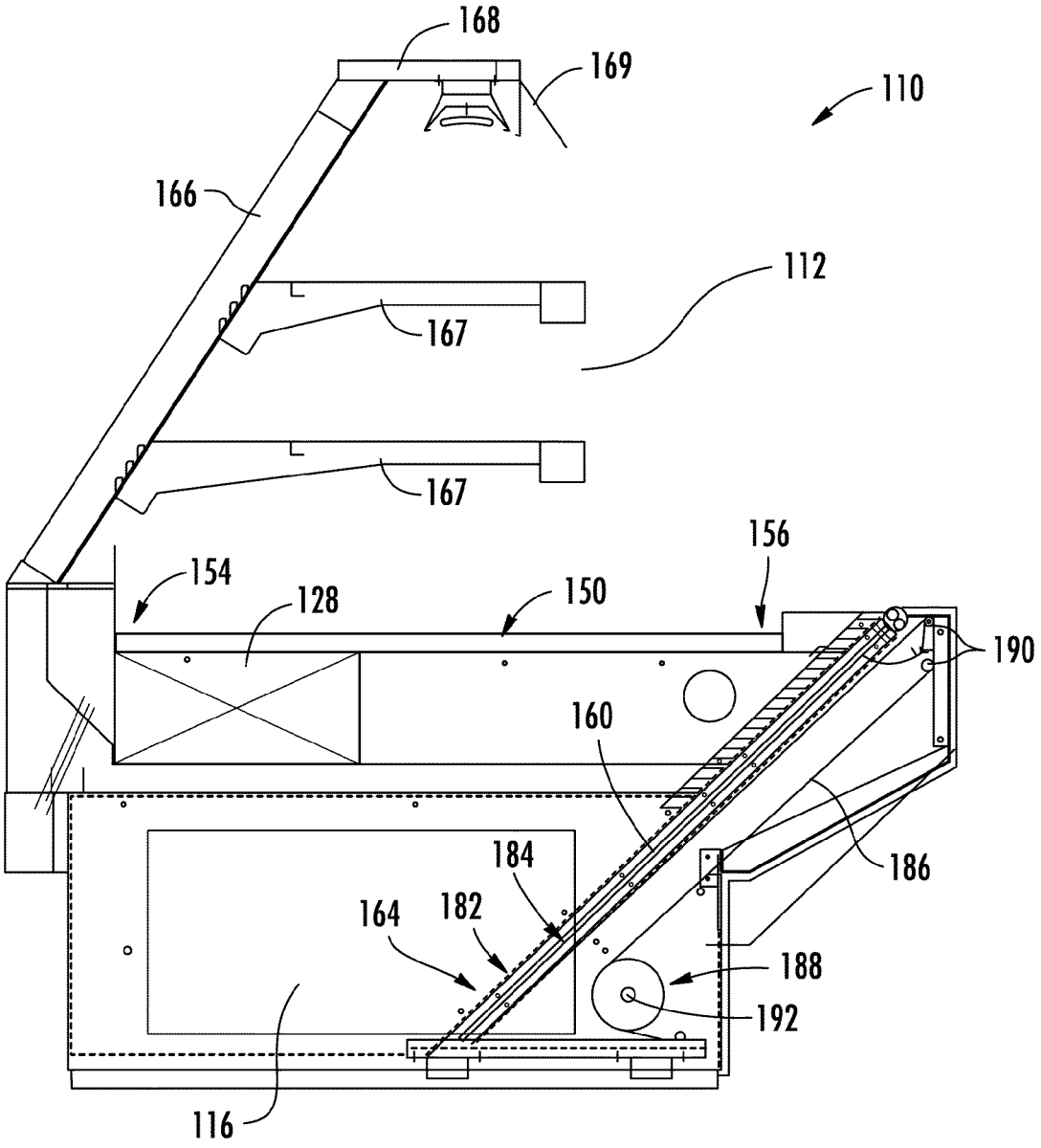
FIG. 6 is a schematic image of a side elevation view of the convertible temperature-controlled display device of FIG. 1 having the front panel disposed in a retracted (e.g. stowed) position corresponding to use in a self-service mode of operation.

Referring to FIGS. 4-6, the temperature-controlled display device or case 110 is shown according to an exemplary embodiment for use with heated food products. Heated service case 110 shares a number of similarities with refrigerated service case 10, however, heated case 110 generally omits the refrigeration system components of case 10, and includes a modified back frame member 166 that supports a plurality of shelves 167 and a top frame member 168. Heating elements 128 are provided to heat or otherwise maintain the temperature of the heated food products displayed therein and thermal insulation is provided to thermally isolate the base 150 from a pedestal or stand 116. All such embodiments and variations thereof are intended to be within the scope of this disclosure.

Referring more particularly to the FIGURES, the temperature-controlled display devices, e.g. refrigerated service case 10 and heated service case 110, include features for converting between a full-service mode of operation (such as where service personnel tending to the case would access food products within the temperature controlled space 12, 112 through doors or other suitable openings located on the back side of the cases 10, 110 at the request of customers typically located on a closed front side of the case 10, 110) and a self-service mode of operation where such consumers would typically be capable of accessing the food products themselves directly through an open front side of the case 10, 110. Cases 10, 110 each includes a base portion 50, 150 having a back side 54, 154 and a front side 56, 156 and are configured to support heated or refrigerated products in the temperature-controlled space 12, 112. The case 10, 110 also include a versatile front panel 60, 160 that is readily movable between a deployed position 62 adjacent the front side 56, 156 of the base 50, 150 and across the front of the case 10, 110 and corresponding to the full-service mode of operation (as shown in FIGS. 1 and 4) and a retracted (or stowed) position 64, 164 within a stand or pedestal 16, 116 beneath the base 50, 150 and corresponding to the self-service mode of operation (as shown in FIGS. 3 and 6). Case 10 includes a back frame member 66 (which may define or support doors or other suitable openings for accessing products during the full service mode), and include ducts 30 for distribution of refrigerated air, and which supports a top frame 68, which supports the air outlet 32 and may further support other components of the case 10 (e.g. lighting components such as fluorescent or LED lighting, gravity-type cooling coils and trip pans, etc.). Case 110 includes a back frame member 166 (which may define or support doors or other suitable openings for accessing products during the full service mode), and supports a top frame 168, which may support other components of the case (e.g. lighting components such as fluorescent or LED lighting, etc.).

Front panel 60, 160 has an upper edge or portion 70, 170 that rests and seals against a flange 69, 169 or other structure on top frame 68, 168 when front panel 60, 160 is in the deployed position 62, 162. The upper edge 70, 170 may further include a lip, ledge or other structure that may function as a handle and as a travel stop when moving the front panel 60, 160 between the deployed position 62, 162 and the stowed position 64, 164. Front panel 60, 160 also has a lower edge or portion 72, 172 that is pivotally coupled at a pivot/slide connection 80, 180 at each lateral side (e.g. by suitable posts or axles, etc.) to tracks 82, 182 disposed along opposite lateral sides of an elongated pocket 84, 184 (e.g. receptacle, compartment, etc.) that extends angularly into the pedestal 16, 116 beneath the base 50, 150 of the case 10, 110. The pocket 84, 184 may be substantially "closed" with an upper panel, lower panel, and bottom according to one embodiment. Pocket 84, 184 may also be substantially "open" with minimal enclosing structure (other than tracks, glides, etc.). All such embodiments are intended to be within the scope of this disclosure. The tracks 82, 182 may include strips or glides formed from a lubricious material intended to minimize friction and facilitate easy sliding of the front panel 60, 160 on the tracks 82, 182 as it moves into and out of the pocket 84, 184. Tracks 82, 182 may also be provided at intermediate locations across a width of the pocket 84, 184 as necessary to help support the weight of the front panel 60, 160 (which is typically formed from glass, or other suitable transparent material). According to the illustrated embodiment, the front panel 60, 160 is a substantially planar panel and the pocket 84, 184 is also substantially planar in shape with a length, width and a thickness sized to receive the front panel 60, 160 when the front panel 60, 160 is moved to the stowed position 64, 164. However, according to alternative embodiments, the front panel and the corresponding pocket may have other shape profiles, such as curved, etc.).

Referring further to the FIGURES, the front panel 60, 160 may be moved from the deployed position 62, 162 to the stowed position 64, 164 (e.g. to convert case 10, 110 from a full-service case to a self-service case) by rotating top portion 70, 170 of the front panel 60, 160 outwardly about pivot/slide connection 80, 180 (shown by way of example in the FIGURES as clockwise) to a position that is substantially aligned (e.g. co-planar) with pocket 84, 184 (as shown in FIGS. 2 and 5). The front panel 60, 160 may then be lowered (e.g. slid) into the pocket 84, 184 to stow and conceal the front panel 60, 160 within the pedestal 16, 116. Accordingly, the front panel 60, 160 of the present embodiments of the disclosure both rotates about the pivot/slide connection 80, 180 and slides into and out of the pocket 84, 184.

The convertible temperature-controlled display case 10, 110 may also include features intended to help control or assist movement of the front panel 60, 160 between the deployed position 62, 162 and the stowed position 64, 164. For example, the pivot/slide connection 80, 180 or other structure on or near lower edge 72, 172 of front panel 60, 160, and at one or both tracks 82, 182 at the lateral sides of the pocket 84, 184, may be coupled to a cable 86, 186 that is extendably and retractably coupled to a torsion spring 88, 188 (or other suitable biasing device) or the like that is biased to assist in lifting the front panel 60, 160 upward and out of the pocket 84, 184 from the stowed position 64, 164 to the deployed position 62, 162 (e.g. in the manner of a "garage door" type spring or the like) and to provide an increasing resistance that helps offset the weight of the front panel 60,

160 when it is lowered into the pocket 84, 184 when moving from the deployed position 62, 162 to the stowed position 64, 164.

According to one embodiment, a cable 86, 186 is provided at both lateral sides of the front panel 60, 160 and the pocket 84, 184 to balance the weight of the front panel 60, 160 and minimize the tendency for racking or misalignment as the front panel 60, 160 is moved into, and out of, the pocket 84, 184. The cable 86, 186 is coupled at or adjacent to the lower edge 72, 172 of the front panel 60, 160 and is guided over suitable pulleys 90, 190 (e.g. bushings, rollers, etc.) to a rotatable shaft 92, 192 having a spring 88, 188 coiled thereabout, with one part of the spring 88, 188 coupled to the shaft 92, 192 and another part of the spring 88, 188 coupled to the pedestal 16, 116 (or other fixed structure). As the front panel 60, 160 is lowered into the pocket 84, 184, the front panel 60, 160 pulls the cable 86, 186 over pulleys 90, 190 and rotates the shaft 92, 192 in a first direction that tightens or twists the spring to a more tightly-wound condition to resist or at least partially offset the weight of the front panel 60, 160 as it is lowered into the pocket 84, 184. As the front panel 60, 160 is moved out of the pocket 84, 184, the cable 86, 186 retracts over pulleys 90, 190 as the shaft 92, 192 rotates (i.e. unwinds) in a second (opposite) direction and returns toward its original position and releases stored energy to assist in lifting the weight of the front panel 60, 160 as it is raised from the pocket 84, 184. Although the biasing device is shown and described as a torsional coil spring (such as a garage door spring or the like), the biasing device may be any of a wide variety of other devices capable of storing and releasing energy to assist in positioning the front panel into, and out of, the pocket, including, by way of example, pneumatic cylinders or accumulators, extension coil springs, etc. According to further embodiments, the pocket (or the tracks) may include bumpers, cushions, dashpots, dampers or the like to cushion the front panel as it reaches its fully-stowed position within the pocket.

According to other embodiments, in refrigerated service case 10, the operation of the refrigeration system's components may be configured to change when the front panel 60 is moved from the deployed position 62 to the stowed position 64 (and vice versa, i.e. from the stowed position 64 back to the deployed condition 62) in order to enhance operational efficiency and thermal performance of the case 10 in each mode. For example, the refrigeration system may be configured to operate with an increased airflow velocity at the return opening 24 when the front panel 60 is moved from the deployed (i.e. closed) position 62 to the stowed (i.e. open) position 64, in order to more effectively draw the chilled air from the temperature controlled space 12 across the open front and back to the cooling coil 28. Alternatively, the refrigeration system may be configured to operate with a decreased airflow velocity at the return opening, in order to maintain a desired temperature of the food products during the self-service mode (i.e. with the front of the case in an open condition). According to one embodiment, such a change in airflow velocity (e.g. increasing or decreasing) may be accomplished by repositioning of a damper or louver or the like (not shown) within the airflow path. According to another embodiment, such a change in airflow velocity may be accomplished by changing a speed of the fan 26. The change in operation of the refrigeration system (e.g. positioning dampers, changing fan speeds, cooling coil temperature or operation, etc.) may be accomplished manually or automatically. For example, a switch or pushbutton or the like may be provided that may be actuated by a user when the user manually repositions the front panel 60 from the deployed position 62 to the stowed position 64 (and vice versa). According to another example, operational change of the refrigeration system may be accomplished automatically, such as through a position switch or other suitable sensor disposed at (or operationally adjacent to) the front panel 60 or the pocket 84 or other suitable location such that upon moving the front panel 60 from the deployed position 62 to the stowed position 64 (or vice versa) the switch or sensor is deployed to also change operation of the refrigeration system to the corresponding operational mode.

According to any exemplary embodiment, the versatile temperature-controlled display case 10, 110 is convertible between a full-service mode and a self-service mode of operation. The case 10, 110 includes a base 50, 150 configured to support temperature-controlled products (e.g. hot or cold food products, etc.), and a back frame 66, 166 coupled to the base 50, 150 and providing openings for back-side access of the food products during the full service mode, and a top frame 68 supported by the back frame 66. A movable front panel 60 is provided on a front side of the case 10, 110 and is movable between a deployed position 62, 162 (across the front of the case 10, 110 to close the front of the case, and corresponding to the full-service mode), and a retracted or stowed position 64, 164 (within a pedestal of the case) for front-side access to the food products. The front panel 60, 160 is coupled to a pivot/slide mechanism that permits upward rotational movement of the front panel 60, 160 into alignment with a pocket 84, 184 within the pedestal 16, 116, and then sliding movement of the front panel 60, 160 into the pocket 84, 184. Travel stops and panel movement control or assist devices or mechanisms (e.g. springs, dampers, bumpers, etc.) may be provided to assist movement of the front panel. For embodiments where the case is a heated service case and the temperature controlled products are heated food products, suitable heating elements 128 and controls are provided within the base 150 to maintain a desired temperature of the hot food products, and thermal insulation is provided to thermally isolate the heating elements 128 and the temperature controlled space 112 from adjacent devices. For embodiments where the case is a refrigerated service case and the temperature controlled products are refrigerated food products, a refrigeration system (e.g. cooling coil 28, fan 26 and airflow circuit 30, or gravity cooling coils, pans chilled be a circulating coolant, etc.) is adaptable manually or automatically to change operating modes or characteristics corresponding to the different environments created in the temperature-controlled space 12 when the front panel 60 is moved from the deployed position 62 to the stowed position 64 (or vice versa). Such a change in operating mode may be accomplished by a switch or the like manually activated by a user, or may be accomplished automatically by a suitable sensor positioned and configured to detect movement of the front panel 60 (e.g. to detect when the front panel is, and is not, in the deployed position 62 or within the pocket 84).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Moreover, all ranges disclosed herein are to be understood to encompass any and all subranges subsumed therein. For example, a stated range of 1 to 10 should be considered to include any and all subranges between and inclusive of the minimum value of 1 and the maximum value of 10; that is, all subranges beginning with a minimum value of 1 or more and ending with a maximum value of 10 or less (e.g., 5.5 to 10).

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

It is also important to note that the construction and arrangement of the convertible temperature-controlled display case as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A temperature-controlled display case convertible for operation in a full-service mode and a self-service mode, the temperature-controlled display case defining a temperature-controlled space therein and comprising:

a base having a back side and a front side, and configured to support temperature-controlled food products within the temperature-controlled space;

a pedestal disposed beneath the base and having a pocket defined therein;

a back frame coupled adjacent to the back side of the base and providing one or more openings configured to provide back side access to the food products during the full-service mode;

a top frame supported by the back frame;

a front panel having an upper portion and a lower portion, the front panel movable between a deployed position for the full-service mode with the upper portion of the front panel adjacent to the top frame, and a stowed position for the self-service mode with the front panel disposed within the pocket to provide front side access to the food products; and one or more tracks cooperating with the pocket to guide the front panel into and out of the pocket.

2. The temperature-controlled display case of claim 1, wherein the food products comprise heated food products and wherein the base further comprises heating elements and thermal insulation configured to maintain a temperature of the hot food products.

3. The temperature-controlled display case of claim 1, wherein the food products comprise refrigerated food products and wherein the base further comprises a cooling coil and a fan configured to circulate refrigerated air through the temperature-controlled space.

4. The temperature-controlled display case of claim 3, further comprising a switch operable to change a speed of the fan or an operating condition of the cooling coil when the front panel is moved from one of the deployed position or the stowed position to the other of the deployed position or the stowed position.

5. The temperature-controlled display case of claim 4, wherein the switch is configured to be operated automatically upon movement of the front panel.

6. The temperature-controlled display case of claim 1, wherein the tracks comprise one or more glides formed from a lubricious material.

7. The temperature-controlled display case of claim 1 further comprising a spring configured to resist downward movement of the front panel as it is received in the pocket and to assist upward movement of the front panel as it is withdrawn from the pocket.

8. The temperature-controlled display case of claim 1, further comprising a cable having one end coupled to the lower portion of the front panel and another end coupled to the spring.

9. The temperature-controlled display case of claim 1, wherein the pocket comprises cushions to support the front panel in the stowed position.

10. The temperature-controlled display case of claim 1, wherein the front panel is substantially planar and the pocket is shaped to receive the substantially planar front panel.

11. The temperature-controlled display case of claim 1, wherein the front panel is curved and the pocket is shaped to receive the curved front panel.

12. The temperature-controlled display case of claim 1, wherein the upper portion of the front panel further comprises a handle.

13. A convertible temperature-controlled display case, comprising:

a base having a back side and a front side;

a pedestal disposed beneath the base and having a pocket defined therein;

a back frame coupled to the base and providing one or more openings configured to provide back side access;

a top frame supported by the back frame;

a movable front panel having an upper portion and a lower portion, the front panel selectively movable between a deployed position with the upper portion of the front panel adjacent to the top frame, and a stowed position with the front panel disposed within the pocket;

a switch operable to change an operating condition of the display case when the front panel is moved from one of the deployed position or the stowed position to the other of the deployed position or the stowed position.

14. The temperature-controlled display case of claim 13, wherein the base further comprises heating elements and thermal insulation.

15. The temperature-controlled display case of claim 13, wherein the base further comprises a cooling coil and a fan configured to circulate refrigerated air.

16. The temperature-controlled display case of claim 15, wherein the switch is operable to change a speed of the fan or an operating condition of the cooling coil when the front panel is moved from one of the deployed position or the stowed position to the other of the deployed position or the stowed position.

17. A method of providing convertible temperature-controlled display case, comprising:

providing a base having a back side and a front side;

providing a pedestal disposed beneath the base and having a pocket defined therein;

coupling a back frame to the base having one or more openings configured to provide back side access;

providing a top frame supported by the back frame;

providing a movable front panel having an upper portion and a lower portion, the front panel selectively movable between a deployed position with the upper portion of the front panel adjacent to the top frame, and a stowed position with the front panel disposed within the pocket;

providing a switch operable to change an operating condition of the display case when the front panel is moved from one of the deployed position or the stowed position to the other of the deployed position or the stowed position.

* * * * *